US006002120A

United States Patent [19]

De Matteis

[11] Patent Number: 6,002,120

[45] Date of Patent: Dec. 14, 1999

[54] ELECTRIC MICROWAVE OVEN WITH IMPROVED ENERGY DISTRIBUTION

[75] Inventor: Michel De Matteis, Chambes-en-Plaine, France

[73] Assignee: Moulinex S.A., Paris, France

[21] Appl. No.: 09/011,908

[22] PCT Filed: Aug. 22, 1996

[86] PCT No.: PCT/FR96/01304

§ 371 Date: Feb. 23, 1998

§ 102(e) Date: Feb. 23, 1998

[87] PCT Pub. No.: WO97/08497

PCT Pub. Date: Mar. 6, 1997

[30] Foreign Application Priority Data

Aug. 25, 1995 [FR] France ..... 95 10112

[51] Int. Cl.[6] ..... H05B 6/78

[52] U.S. Cl. ..... 219/754; 219/763

[58] Field of Search ..... 219/754, 752, 219/745, 746, 762, 763

[56] References Cited

U.S. PATENT DOCUMENTS

| | | | |
|---|---|---|---|
| 3,428,772 | 2/1969 | Wallenfels | 219/754 |
| 4,140,888 | 2/1979 | Baron et al. | 219/746 |
| 4,329,557 | 5/1982 | Staats | 219/746 |
| 4,337,384 | 6/1982 | Tanaka et al. . | |
| 4,481,396 | 11/1984 | Matsubayashi et al. . | |
| 5,468,940 | 11/1995 | Kang | 219/763 |

FOREIGN PATENT DOCUMENTS

| | | | |
|---|---|---|---|
| 1-255186 | 10/1989 | Japan | 219/746 |

*Primary Examiner*—Philip H. Leung
*Attorney, Agent, or Firm*—Young & Thompson

[57] ABSTRACT

An electric oven includes a microwave energy source (2), a waveguide (3) with an output section that terminates in a cooking enclosure defined by a base wall (4), a top wall (5), a sole wall (6) and two side walls (7, 8), and a rotary device (R) inside the cooking enclosure, for receiving food products to be cooked, and rotated by control elements (23) external to the cooking enclosure. The rotary device (R) has two or more rotary plates (9, 10), an upper (9) and a lower (10) plate, removably mounted in the cooking enclosure, one above the other and spaced from each other by a distance d, and the output section of the waveguide (3) is adapted to allow a suitable distribution of the waves on the two plates (9, 10).

8 Claims, 3 Drawing Sheets

ELECTRIC MICROWAVE OVEN WITH IMPROVED ENERGY DISTRIBUTION

The invention relates to an electric cooking oven comprising a microwave energy source, a waveguide whose outlet opens into a cooking chamber delimited by a rear wall, a top wall, a bottom wall and two side walls and a rotatable device within the cooking chamber, adapted to receive the foodstuffs to be cooked and to be driven in rotation by control means disposed outside the cooking chamber.

BACKGROUND OF THE INVENTION

Such an electric cooking oven permits generally placing, in the cooking chamber, a single dish of a foodstuff. Thus, given the construction of the rotatable device, when a user desires to treat several dishes, either different or the same for several persons, he must successively position the dish within the cooking chamber, program said electric cooking oven and, finally, start the operation of said electric oven. This operation is hence repeated as many times as there are dishes to be treated and requires, because of this, numerous manipulations by the user. On the other hand, in such cooking apparatus, when the foodstuffs to be cooked are disposed in receptacles or packages that are superposed and of dimensions adjacent that of the cooking chamber, these latter prevent good distribution of the microwaves, thereby leading to different treatments of the foodstuffs.

The object of the invention is to overcome these mentioned drawbacks by providing an electric cooking oven permitting treating simultaneously several foodstuffs.

SUMMARY OF THE INVENTION

According to the invention, the rotatable device comprises at least two rotatable plates, namely a lower plate and an upper plate, mounted removably in the cooking chamber, superposed and spaced from each other by a distance d and the outlet of the waveguide is adapted to promote good distribution of the waves over the two plates.

Thanks to an ingenious arrangement of the new rotatable device for reception in the cooking chamber, the manipulation of the dishes in the oven is greatly improved. Moreover, such a new rotatable reception device increases the conventional capacities of electric cooking ovens, namely the possibility of treating simultaneously several dishes, thereby limiting the consumption of electricity and increasing the rapidity of preparation of meals. On the other hand, judicious adaptation of the outlet in the cooking chamber improves, thanks to its correlation with said new rotatable reception device, the distribution of microwave energy in the cooking chamber and as a result each of the foodstuffs to be cooked disposed at different levels in the cooking chamber are subject to optimum microwave radiation permitting obtaining very good treatment of said foodstuff to be cooked.

BRIEF DESCRIPTION OF THE DRAWINGS

Other characteristics and advantages of the invention will become apparent from the description which follows, given by way of non-limiting example, with reference to the accompanying drawings, in which.

DESCRIPTION OF THE PREFERRED EMBODIMENTS

Figure 1:
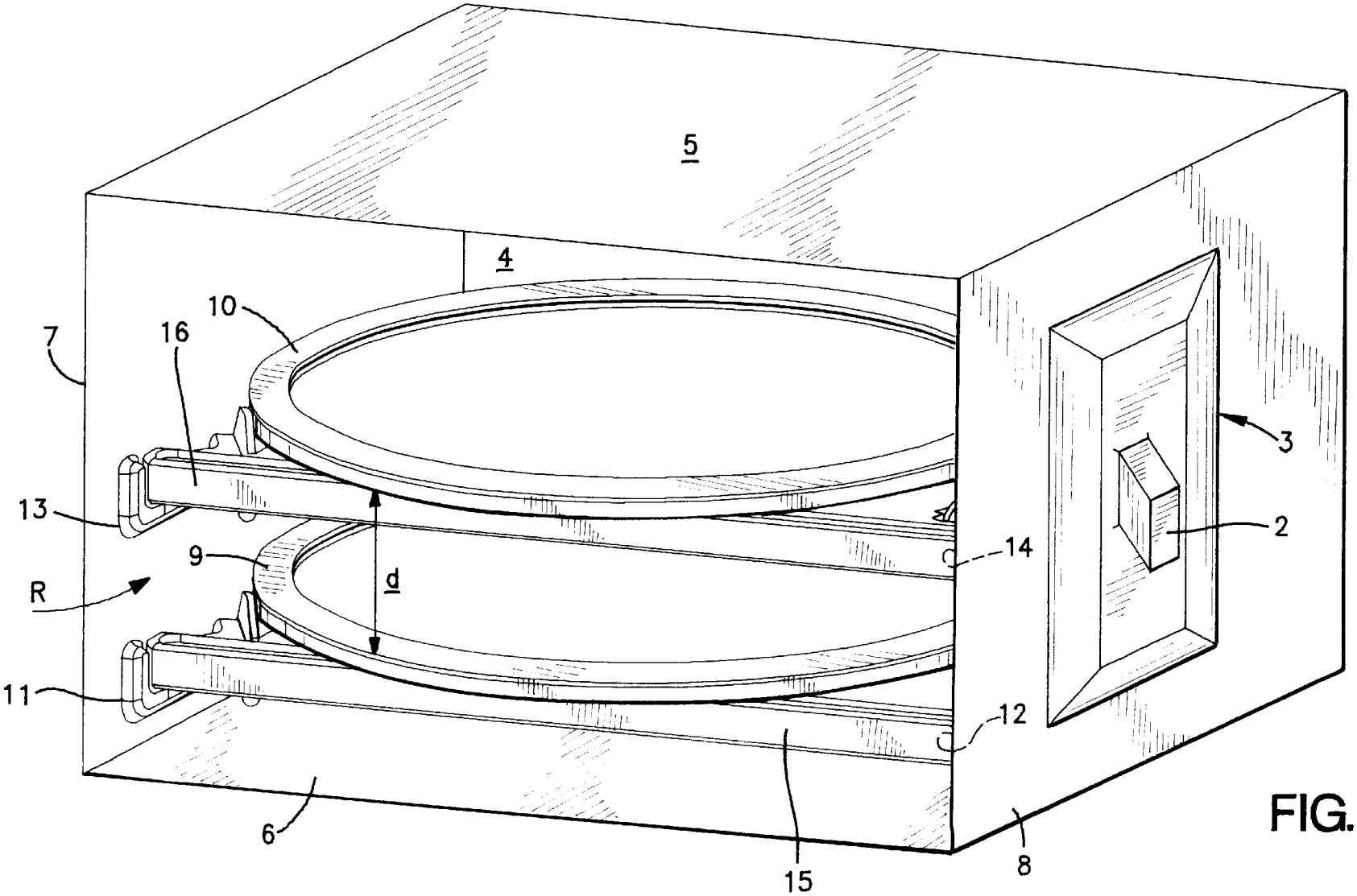
FIG. 1 shows, schematically in perspective, a cooking chamber of an electric oven according to the invention, provided with a first rotatable reception device.

According to FIG. 1, the electric cooking oven comprises, among other things, a source of microwave energy 2 such as for example a magnetron, a waveguide 3 whose outlet opens into a cooking chamber delimited by a rear wall 4, a top wall 5, a bottom wall 6, two side walls 7 and 8 and a door (not shown). In the illustrated example, the microwave energy source 2 and the waveguide 3 are fixed on the side wall 8. The cooking chamber has for example the shape of a parallelogram, but any other geometric form is acceptable. The electric cooking oven comprises, among other things, a rotatable device R adapted to receive the dishes or the foodstuffs to be cooked and driven by control means 23 (FIG. 3) disposed outside the cooking chamber, preferably behind the rear wall 4.

According to the invention, the rotatable device R comprises at least two rotatable plates 9, 10, namely a lower plate 9 and an upper plate 10, mounted removably in the cooking chamber, superposed and spaced from each other by a distance d, and the outlet of the waveguide 3 is adapted to promote good distribution of the waves over the two plates 9 and 10.

The rotatable plates are preferably circular. The microwave energy source emits, for example, the radiation whose frequency is 2450 Mhz.

In FIG. 1, it can be seen that the cooking chamber comprises, for each of the rotatable plates 9, 10, two guide means 11, 12; 13, 14, of which only 11, 13 of the two guide means are visible. The upper rotatable plate 10 and lower rotatable plate 9 are mounted respectively for rotation by any known means, on removable supports 15, 16 resting respectively on guide means. The supports 15, 16 comprise transmission means 19 for the rotatable movement interposed by coupling between the control means 23 and the rotatable plates 9, 10. The control means 23 (not shown in this figure) are arranged on at least one of the walls of the chamber and comprise at least one electric motor group. The upper rotatable plate and lower rotatable plate having dimensions substantially close to the dimensions of the cooking chamber, the two guide means 11, 12; 13, 14 are disposed respectively on each of the side walls 7 and 8 of the cooking chamber, so as easily to position each of the rotatable plates. As will be seen, the two guide means 11, 12 of the lower plate 9 are disposed adjacent the bottom wall 6, and the two guide means 13, 14 of the upper plate 10 are disposed substantially at mid-height in the cooking chamber.

Preferably, according to a preferred embodiment, the outlet of the waveguide 3 comprises at least two openings 30 and 32 (see FIG. 4 or 5) of which one, :32, is arranged between the rotatable plates 9, 10.

Figure 4:
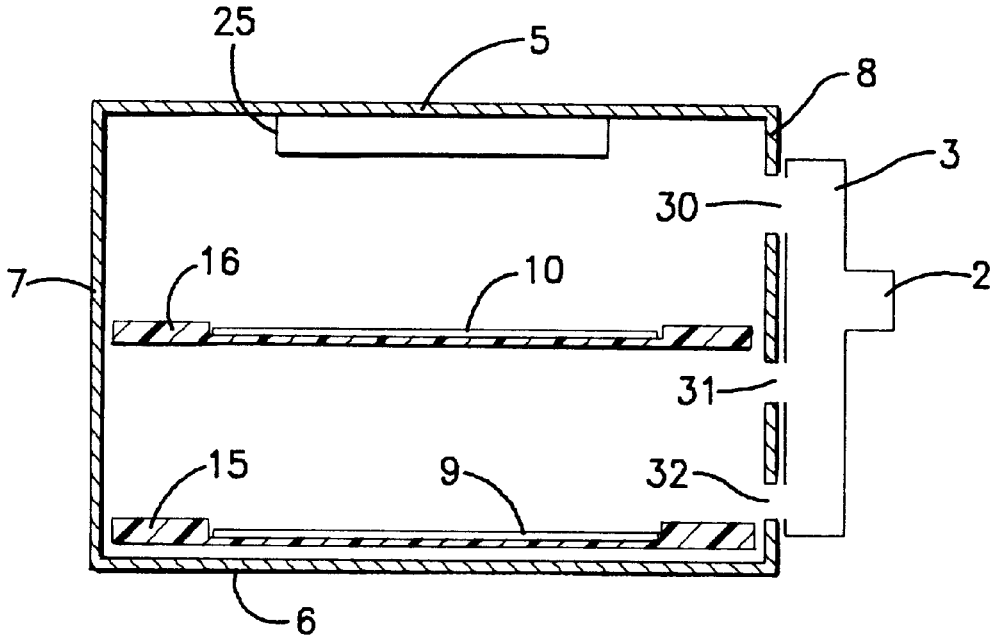
FIGS. 4 and 5 are cross sectional elevational views of the chamber of the oven and of the waveguide according to two possible modified embodiments of the invention.
Figure 5:
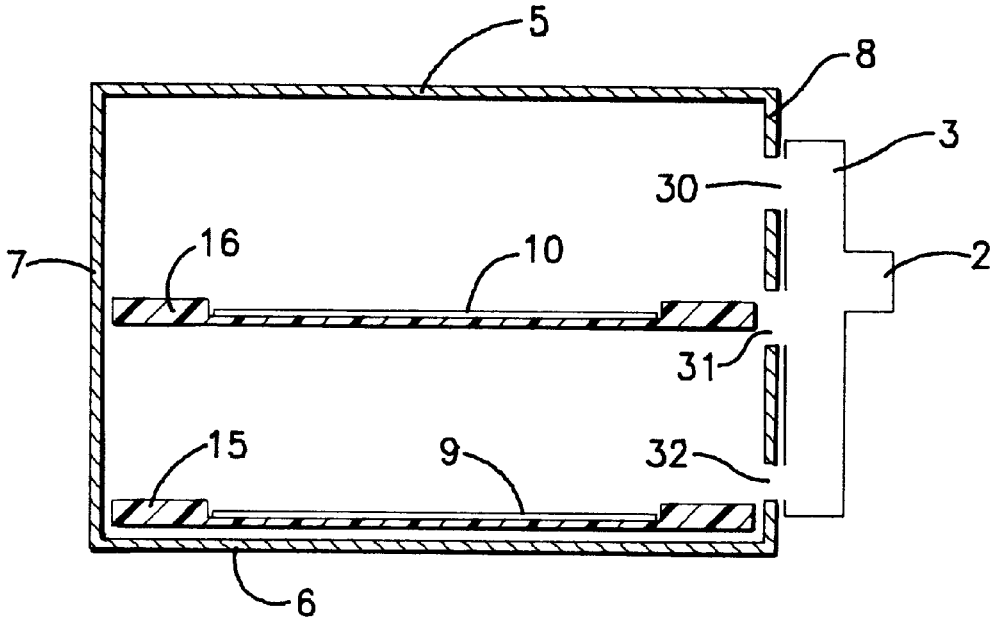

In modified embodiments shown in FIGS. 4 and 5, the outlet of the waveguide 3 comprises three openings 30, 31 and 32: a first opening 32 is located between the lower plate 9 and the upper plate 10; a second opening 30 is located above the upper plate 10; finally, an intermediate opening 31 is located either below the upper plate 10 (FIG. 4), or substantially at the level of this upper plate 10 (FIG. 5). In this latter case, the best results for distribution of the waves are obtained by arranging that most of the waves issue from the waveguide by the intermediate opening 31, and enter the chamber at a level located below the upper plate 10.

Figure 2:
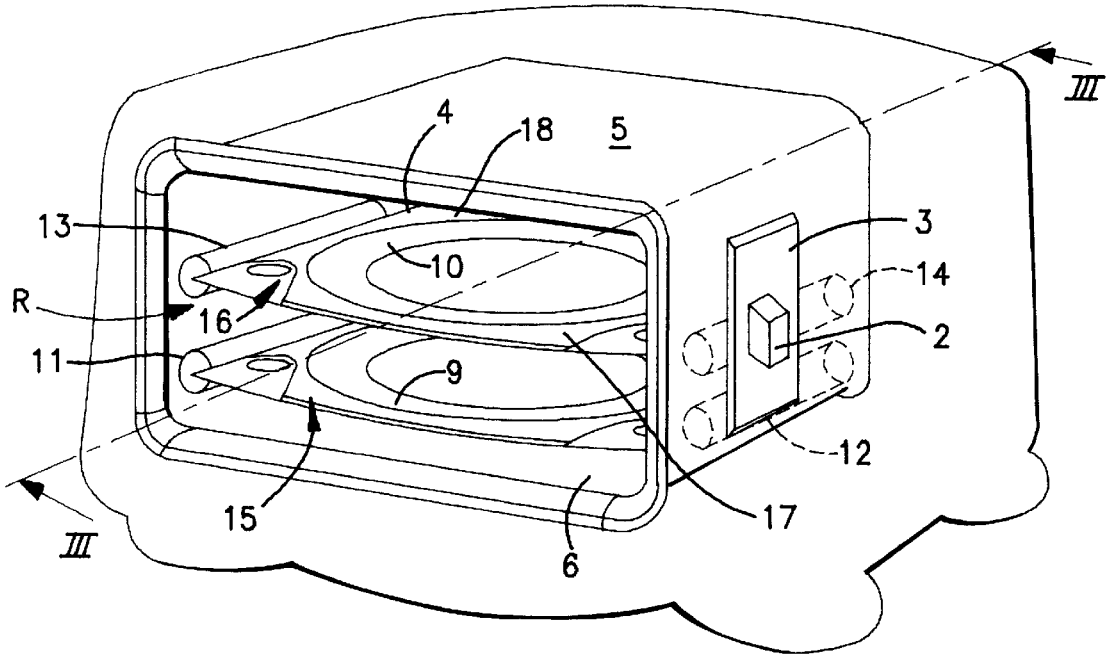
FIG. 2 shows schematically in perspective on a reduced scale another embodiment of an electric cooking oven according to the invention, and provided with a second rotatable device.

In a preferred embodiment as shown in FIG. 2, and in which the same reference numerals are used to designate similar members, each of the rotatable plates 9, 10 is mounted rotatably respectively on a removable support 15, 16 having the form of a rectangular plate whose width and depth are practically identical to the width and depth of the interior of the cooking chamber. Each of said removable supports 15, 16 comprises a front portion 17 and a rear portion 18, said rear portion 18 being adapted to come into contact against the rear wall 4 when said removable support 15, 16 is correctly positioned within the cooking chamber. Each removable support 15, 16 is constituted preferably of a material transparent to microwaves such as a plastic, and the rotatable plate 9, 10 is preferably of quenched glass. Such a removable support 15, 16 comprises transmission means 19 (FIG. 3) interposed in coupled relationship between the control means 23 and the rotatable plate 9, 10. The removable support is positioned, for example, on guide means 11, 12; 13, 14 fixed on the side walls 7, 8 of the cooking chamber, and having in this embodiment the form of longitudinal slideways.

Figure 3:
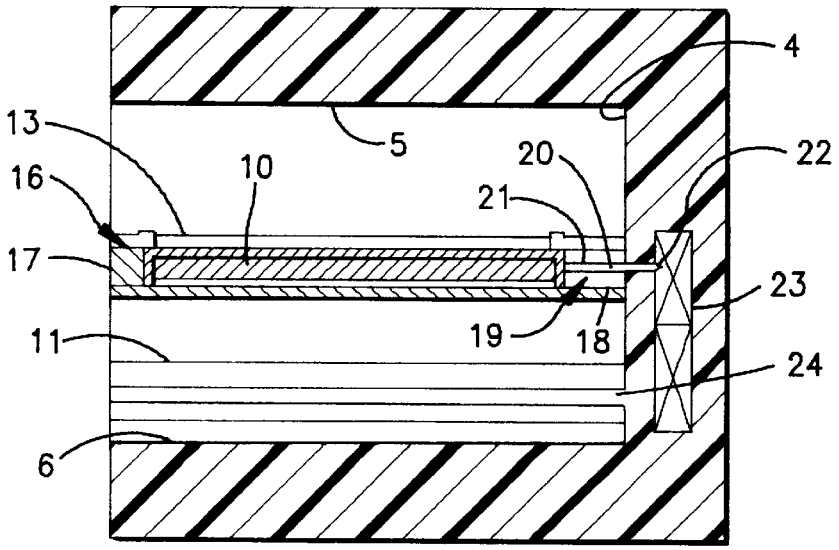
FIG. 3 is a vertical cross section, on a slightly enlarged scale, on the line I—I of FIG. 2, but in which the rotatable device is only partially represented.

According to FIG. 3, in which the elements of FIGS. 1 and 2 are designated by the same reference numerals, only the upper removable support 16 and the plate 10 are positioned in the cooking chamber.

The transmission means 19 of the upper removable support 16 comprise a shaft 20 whose end 21 is fixed on the rear portion 18 of the removable support 16 facing the rear wall 4 and whose other end 22 is adapted to couple with the control means 23 comprising among other things an electric motor (not shown). When the user places the removable support 16 in the cooking chamber, the shaft 20 passes through a hole 24 provided in the rear wall 4, which facilitates connection with the control means 23.

As will be understood, the control means 23 and the transmission means 19 for the removable support 15 and the plate 9 are of a construction similar to that described above. Nevertheless, for this lower plate 9, can also be envisaged another rotatable plate without sliding support, with rotation control means arranged in that case below the bottom wall 6 in a manner known per se.

According to a different embodiment (shown in FIG. 4) of a microwave electric cooking oven, the cooking chamber is provided also with heating resistance means disposed below the top wall 5, said resistance is spaced by a suitable distance from the upper rotatable plate 10 so as to ensure that the infrared radiation will not burn the dishes disposed on the plate 10.

Other modifications are possible, for example, the use of three removable supports.

Thanks to the invention thus provided, it will be understood that the electric cooking oven thus constituted is easy to use for the user and facilitates the simultaneous treatment of several dishes and meals. Thus, the user desiring to treat several dishes or meals, positions the different removable supports in the cooking chamber to the position shown in FIG. 3. Then, the user places the receptacles containing the foodstuffs to be cooked, on each of the rotatable plates disposed in the cooking chamber. The user then programs the electric oven according to the nature of the foodstuffs constituting the dishes placed in said cooking chamber and triggers, after having verified the closing of the door of the cooking chamber, the operation of said oven. Thanks to the adaptation of the outlet of the waveguide 3 to the rotatable plates so as to obtain good distribution of the waves, and particularly to the arrangement of the opening between the two rotatable plates 9, 10, there is obtained a practically homogeneous heating of the two stages of the rotatable plates.

On the other hand, as a function of the foodstuffs to be treated, the user can position one and/or the other of the removable plates in the cooking chamber so as to be able to treat one or several foodstuffs.

Moreover, thanks to the transmission means 19, of the removable supports 15, 16, the emplacement or removal of these supports is simple and automatic, thereby ensuring on the one hand, facility of cleaning of the cooking chamber and, on the other hand, great ease of use of the oven for a family of a users.

I claim:

1. Electric cooking oven comprising a source of microwave energy, a waveguide having outlet means structured and arranged to guide microwave energy into a cooking chamber delimited by a rear wall, a top wall, a bottom wall and two side walls, and a rotatable device within the cooking chamber adapted to receive foodstuffs to be cooked and driven in rotation by control means disposed outside the cooking chamber, said rotatable device comprising at least two rotatable plates, namely a lower plate and an upper plate, mounted removably in the cooking chamber, superposed and spaced from each other by a distance d, wherein the cooking chamber comprises two guide means for each of the rotatable plates, said two guide means being disposed respectively on each of the side walls of the cooking chamber, each of the rotatable plates being mounted on a removable support comprising transmission means for the rotatable movement interposed by coupling between the control means and the rotatable plate, and positioned on the two guide means fixed to the side walls of the cooking chamber, and the outlet means of the waveguide being structured and arranged to promote good distribution of the waves over the two plates.

2. Electric cooking oven according to claim 1, wherein the two guide means of the lower plate are disposed adjacent the bottom wall, and the two guide means of the upper plate are disposed substantially at mid-height within the cooking chamber.

3. Electric cooking oven according to claim 1, wherein the outlet means of the waveguide comprise at least two openings of which one is arranged between the rotatable plates.

4. Electric cooking oven according to claim 1, wherein the removable support comprises a front portion and a rear portion, the transmission means for the rotatable movement of each of the rotatable plates comprising a shaft having one end fixed on the rear portion of the removable support facing the rear wall, and another end structured and arranged to couple with the control means.

5. Electric cooking oven according to claim 1, wherein the chamber is provided with at least one resistance heater disposed below the upper wall, said resistance heater being sufficiently spaced from the upper rotatable plate so as to prevent burning by infrared radiation of dishes disposed on said upper plate.

6. Electric cooking oven according to claim 1, wherein the microwave energy source has a radiation whose frequency is 2450 Mhz.

7. Electric cooking oven according to claim 1, wherein the outlet means of the waveguide comprise a first opening located between the upper rotatable plate and the lower rotatable plate, a second opening located above the upper rotatable plate, and a third intermediate opening located below the upper rotatable plate.

8. Electric cooking oven according to claim 1, wherein the outlet means of the waveguide comprise a first opening located between the upper rotatable plate and the lower rotatable plate, a second opening located above the upper rotatable plate, and a third intermediate opening located substantially at the level of the upper rotatable plate.

* * * * *